US005791013A

United States Patent [19]

Lin

[11] Patent Number: 5,791,013

[45] Date of Patent: Aug. 11, 1998

[54] FREE SIZE CURTAIN FRAME

[76] Inventor: Jung-Shung Lin, P.O. Box 372, Hsin-Chu, Taiwan

[21] Appl. No.: 839,891

[22] Filed: Apr. 18, 1997

[51] Int. Cl.[6] ..... E05D 15/00

[52] U.S. Cl. ..... 16/87.2; 160/126

[58] Field of Search ..... 16/87.2, 87 R, 16/94 R, 94 D, DIG. 40; 160/123, 126, 330

[56] References Cited

U.S. PATENT DOCUMENTS

| | | | |
|---|---|---|---|
| 1,529,980 | 3/1925 | Bond | 160/126 |
| 1,595,250 | 8/1926 | Sarkisian | 160/126 |
| 2,521,318 | 7/1950 | Johnson | 160/126 |
| 3,192,994 | 7/1965 | Garber et al. | 160/126 |
| 5,067,542 | 11/1991 | Easley | 160/126 |

*Primary Examiner*—Chuck Mah

[57] ABSTRACT

A free size curtain frame for a two-piece curtain comprises: a pair of mounting brackets fixed to two side members of a windows frame respectively at a top; at least one telescopic tubular stretchable beam for fitting to the width of various windows, mounted on the mounting brackets for hanging a two-pieced main curtain thereon, a positioning clamp adjustably clamped on the beam near a middle having a magnet piece disposed at a lower side thereof, a couple of overlap guiding bars respectively hung on at least two hanging rings nearest to the positioning clamp from adjacent sides respectively having an iron piece disposed at an inner end of a flat portion toward the magnet piece of the positioning clamp, therefore to insure there will be a perfect overlap in the middle of the two-pieced curtain, a spare telescopic beam may also mounted on the mounting brackets for hanging a screen curtain if needed, an additional stretchable beam formed of a rectangular telescopic tube may mounted to a pair of attachable brackets for hanging a decorative cloth if needed, while the attachable brackets are attached to the mounting brackets by a tenon-mortise structure respectively.

1 Claim, 12 Drawing Sheets

FREE SIZE CURTAIN FRAME

FIELD OF THE INVENTION

The present invention relates to a curtain frame with a free size structure, and more particularly to such a curtain frame which comprises at least one telescopic tubular beam used for a selective multiply two peaced curtain.

BACKGROUND OF THE INVENTION

A conventional curtain frame is generally a fixed type, which is mainly comprising a cross beam having a guiding groove, two bracket plates to support two ends of the cross beam, a plurality of slidable hanging lugs disposed to the guiding groove of the cross beam respectively having a hanging hole for hooking a plurality of corresponding hanging hooks on the curtain cloth. Some disadvantages of the conventional curtain frame are as below:

(1) The curtain frame has to be designed specifically to adapt with the width of the window, so the manufacturing of the cross beam is limited by the specific specifications of various windows, mass production is impossible.

Furthermore, the conventional curtain frame has only a single cross beam, if a screen curtain or a front decorative cloth is required, there is no determined space for mounting the additional beams, which causes much difficulties to conform the customer's requirements.

(2) The assembling and mounting of the curtain frame may requires some special tools by a skillful person, which is very inconvenient.

(3)There is no a device at the middle of the cross beam for fixing the two pieces of cloth together or providing an overlap thereat, so the curtain cloth can not be closed completely at the middle.

(4) The last hanging lug at each end of the cross beam is not designed to be fixed, so the side edge of the window will be exposed when the curtain cloth is pulled toward the middle of the window.

(4) The cross bar has to be designed specifically to adapt with the width of the window, so the manufacturing of the cross bar is limited by the specific specifications of various windows, mass production of the cross bar is impossible.

Furthermore, the conventional curtain frame has only a single cross bar, if a screen curtain or a front decorative cloth is needed, an additional frame bar should be provided and fixed by means of an additional bracket and self-taping screws, which causes some difficulties in mounting of the frames.

SUMMARY OF THE INVENTION

It is a primary object of the present invention to provide a free size curtain frame, having at least one stretchable beam to fit various windows of different width.

It is another primary object of the present invention to provide a free size curtain frame which can install one set of stretchable beam for a main curtain, and also may install a second stretchably beam for a screen curtain if needed.

It is a further object of the present invention to provide a free size curtain frame of a two-pieced curtain having an overlap structure at a middle of the stretchable beam, so that the two-pieced curtain cloths can be completely closed and fixed when being pulled toward the middle of the window.

It is also an object of the present invention to provide a free size curtain frame having an attachable additional beam for a decorative cloth if needed.

It is still an additional object of the present invention to provide a free size curtain frame having an annular groove disposed to an end cap respectively at two ends of the stretchable beam thereon for stoping the last ring in the annular groove, therefore, when the curtain cloth is pulled toward the middle of the window, the window edge will not be exposed.

BRIEF DESCRIPTIONS OF THE DRAWINGS

The present invention can be better understood by the detailed descriptions of the following drawings, in which.

DETAILED DESCRIPTIONS OF THE PREFERRED EMBODIMENT

Figure 1:
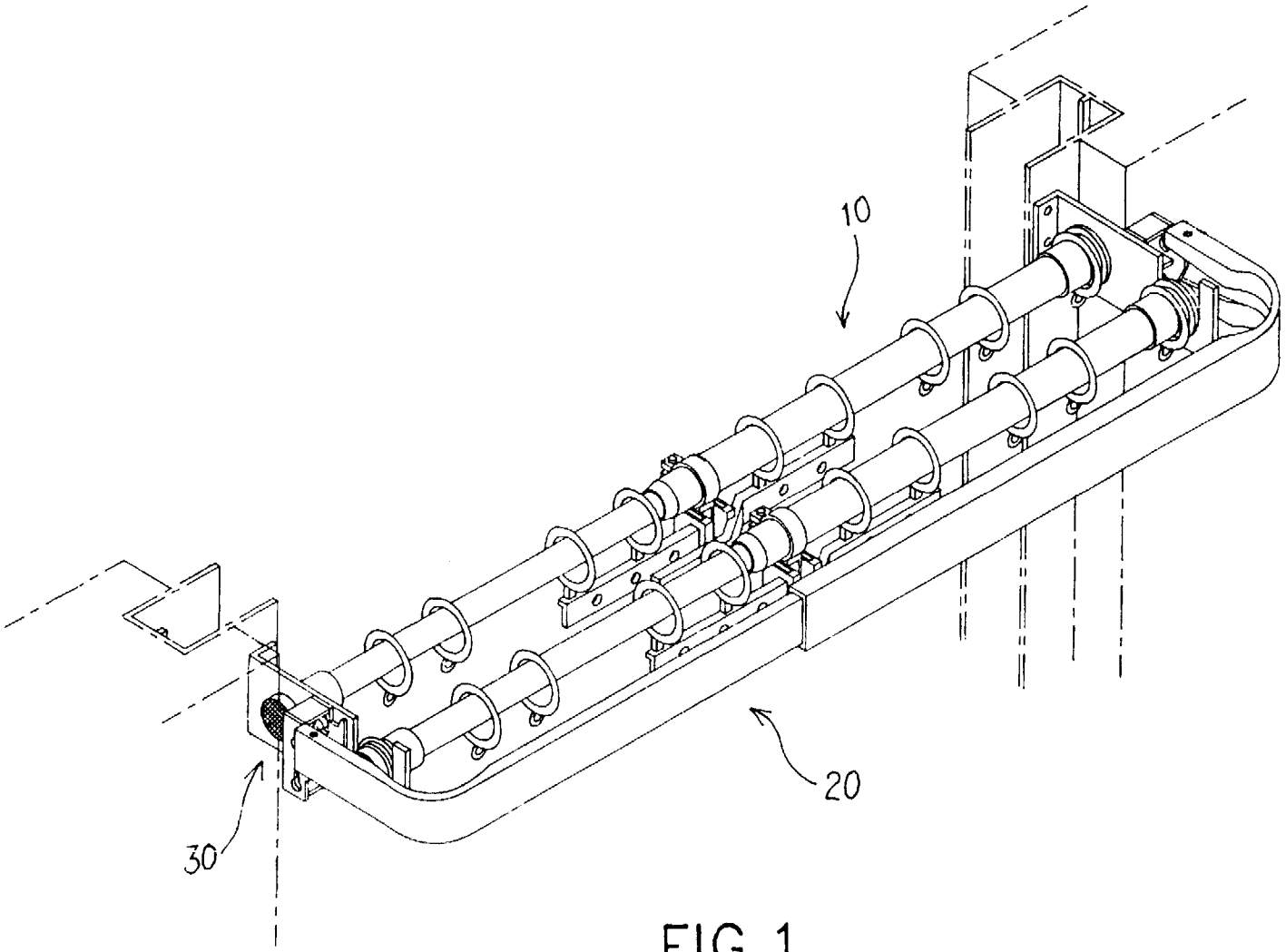
FIG. 1 is a schematic diagram showing a whole assembly structure according the present invention.

Please refer to FIG. 1 which is schematic drawing of a whole assembly of a preferable embodiment according to the present invention. As showing in the figure, there are two telescopic tubular stretchable beams 10 and are additional rectangular stretchable beam 20 fixed on a pair of mounting brackets 30, while the mounting brackets 30 are fixed respectively on a top of the two side members of a window frame.

Figure 2:
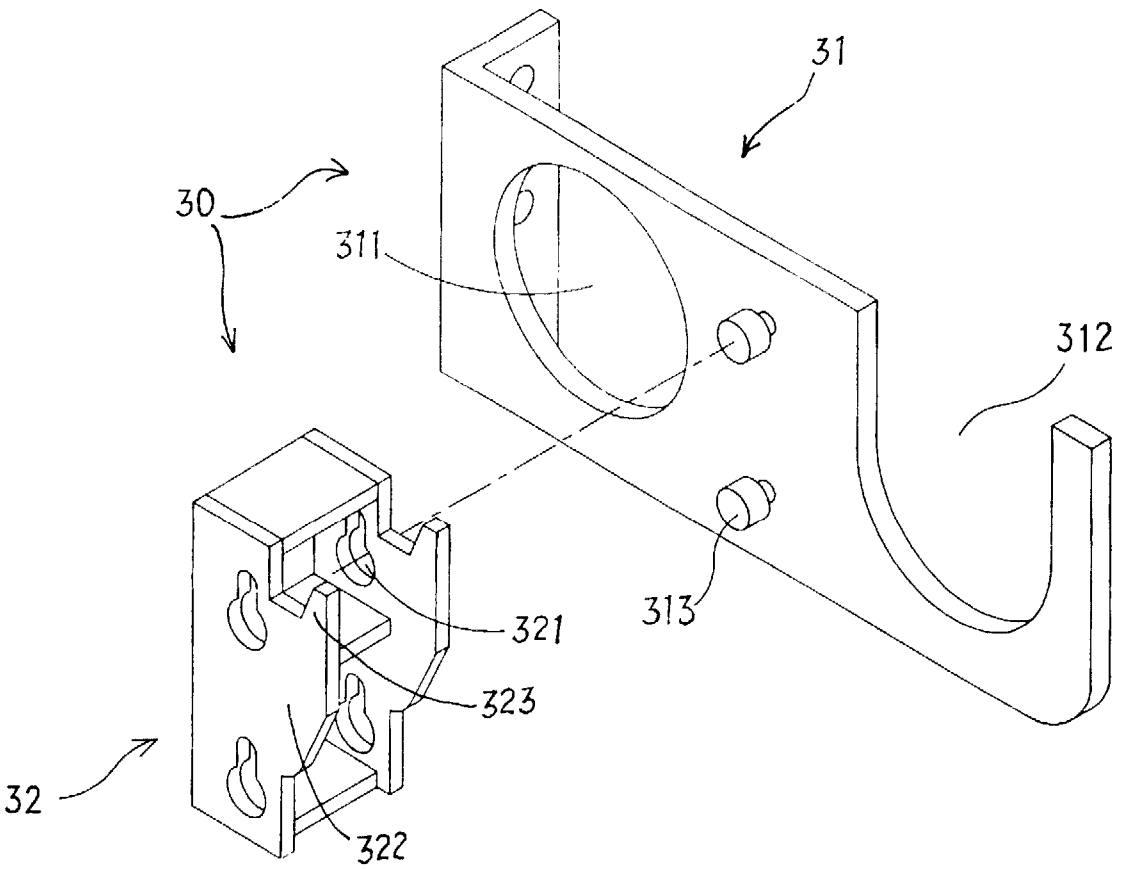
FIG. 2 is a schematic diagram of a mounting bracket and an attachable bracket of the present invention.
Figure 3:
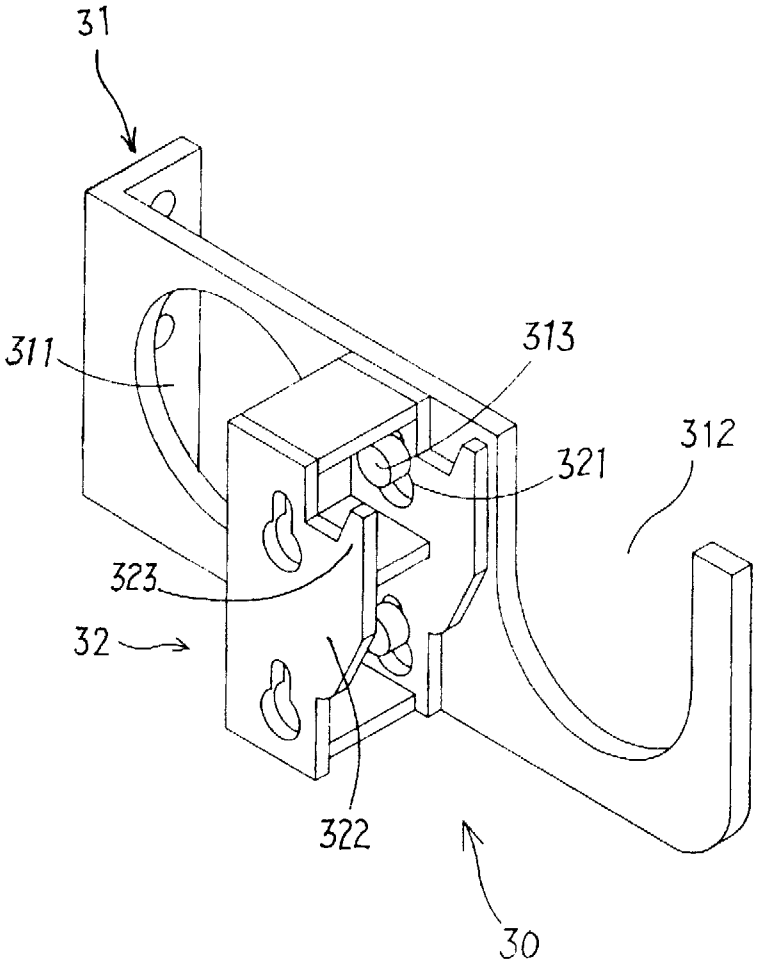
FIG. 3 is a schematic assembly diagram of the mounting bracket shown in FIG. 2.
Figure 4:
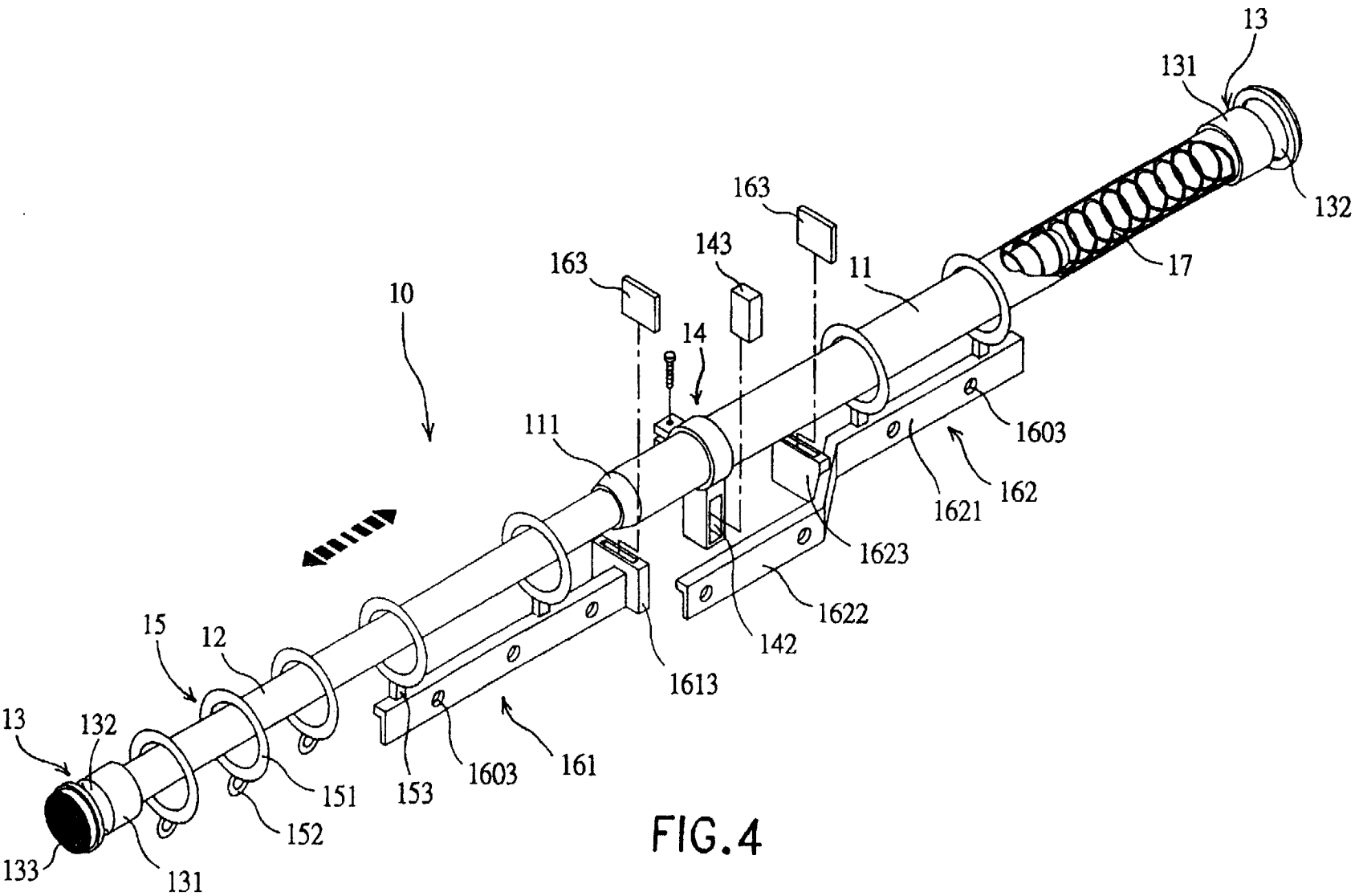
FIG. 4 is a schematic diagram of a stretchable beam structure according to the present invention.
Figure 5:
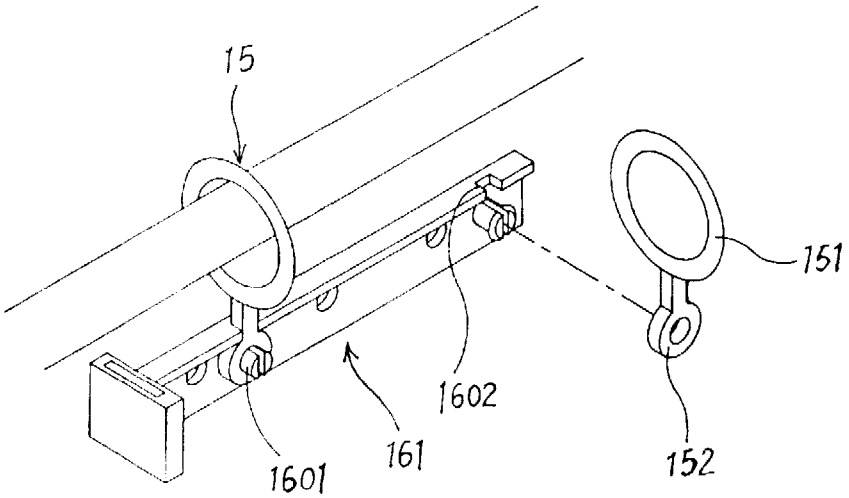
FIG. 5 is a schematic back view of a guiding bar of the present invention.
Figure 6:
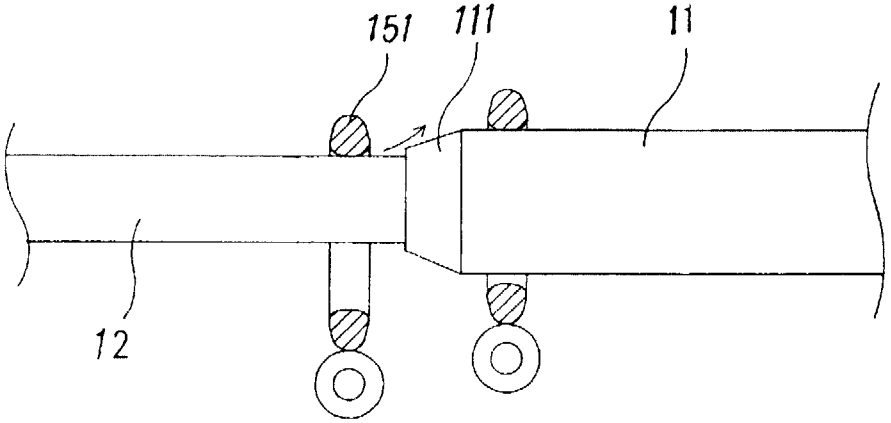
FIG. 6 is a schematic diagram showing the relationship between the stretchable beam and the hanging ring.
Figure 7:
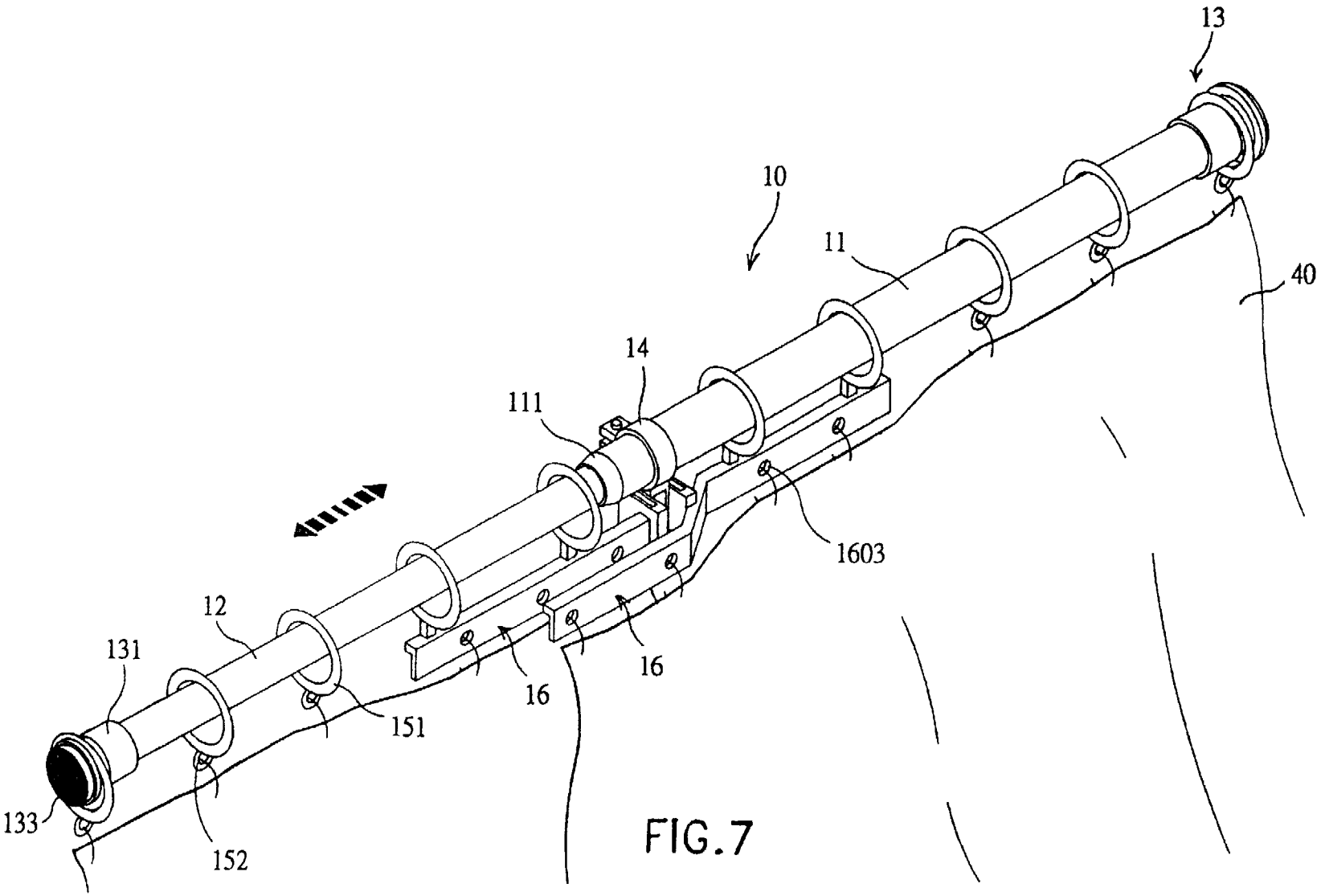
FIG. 7 is a schematic diagram of a two-pieced curtain in closed status of the present invention.

Refer to FIG. 2 and FIG. 3, which shows a mounting bracket 30 comprising an "L" shaped main bracket 31 and a box shaped attachable bracket 30. The main bracket 31 comprises a narrow flat plate having a plurality of through holes for fixing to a top of one of side members of a window frame; and a vertical wide plate perpendicular to the flat plate having a circular supporting opening 311 and a "U" shaped supporting opening 312, and at least two T-head tenons 313 disposed there between. The box shaped attachable bracket 32 has at least two heyhole mortises 321 and a lateral tenon piece 322 with a small square upward tenon 323 disposed on both side walls of the box thereon.Therefore the attachable bracket 32 will be easy to attach on the main bracket 31 only by hanging their keyhole mortises 321 on to the T-head tenons 313 of the main bracket 31 thereon.

Refer to FIG. 4 through FIG. 7, a set of main stretchable beam 10 comprises a telercopic tubular beam body composed of larger main tube 11 and a smaller inner tube sleeved slidable therein, a compression spring 17 disposed in the main tube 11 for retaining a stretch force therefor; a plurality of hanging rings 15 respectively having a round cross section ring body 151 loosely sleeved on the beam body and a tapered portion 111 disposed at one end of the main tube 11 (refer to FIG. 6) and an eyelet 152 disposed to an out edge of the ring body 151 with a 90° twisted thereat for hanging the curtain hooks therein; two end caps nut 13 respectively fastened to respective end of the beam body by threads for mounting the beam set 10 onto the pair of circular opening 311 of the main bracket 31 having a cap body 131, a end plate 133 and an annular groove 132 for retaining a last hanging ring therein to insure that the out edge of the curtain cloth can not be moved while the curtain 40 is pulled toward the middle; a positioning pipe clamp 14 fastend on the main tube 11 of the stretchable beam 10 and adjusted to an appropriate position near a middle, having a magnet housing 142 disposed to a lower portion for receiving a magnet piece 143 therein; a set of guiding bars 16 including a shorter flat bar 161 and a longer fold bar 162 for providing an overlap effect at a middle of a two-pieced curtain 40, respectively hanged on at least two hanging rings 15 adjacent to either side of positioning pipe clamp 14 by snapping at least two split taper pins 1601 respectively disposed to an inner side under a respective notch 1602 of guide bar 161 (refer to FIG. 5) and 162 (not shown) into the eyelet 152 of respective hanging ring 15 therein, and a plurality of small through holes 1603 distributed thereon for hanging the curtain hooks of the curtain 40 therein, the flat bar 161 having an iron piece housing 1613 disposed to an inner end toward to the magnet housing 142 of the positioning pipe clamp 14 for receiving an iron piece 163 therein, while the fold bar 162 having a flat portion 1621 and a folded portion 1622 which the folded portion 1622 is folded outwardly parallel to the flat portion 1621 for covering one half of the flat bar 161 to provide an overlap effect during a two-pieced curtain 40 is closed (refer to FIG. 7), and also an iron piece housing 1623 disposed at an inner end of the flat portion 1621 toward the magnet housing 142 of the positioning pipe clamp 14 for receiving an iron piece 163 therein. Therefore the magnet piece 143 will attract the two iron pieces 163 stuck together to insure the two-pieced curtain 40 been fully closed (refer to FIG. 7).

Figure 8:
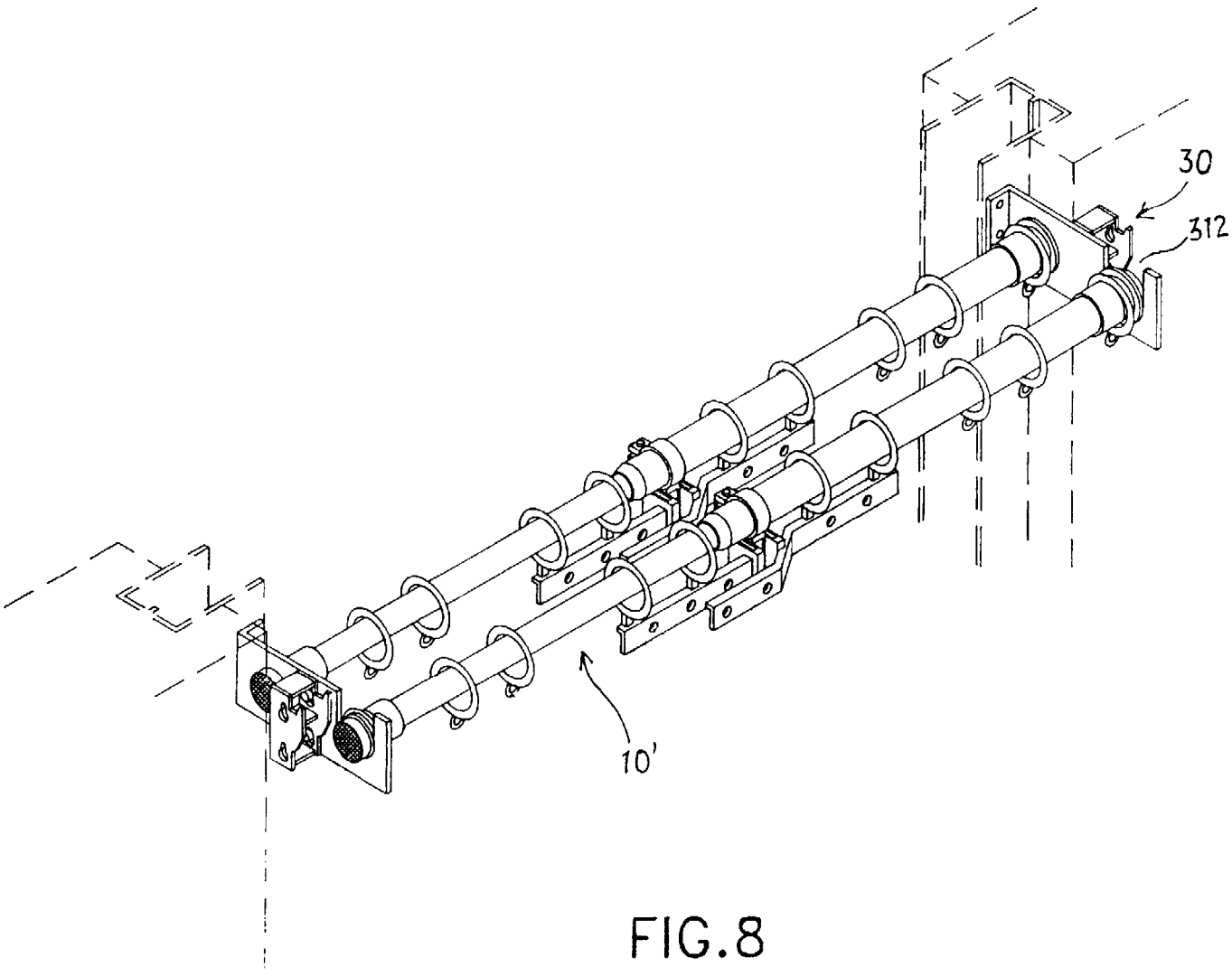
FIG. 8 is a schematic diagram showing two stretchable beams mounted onto the mounting brackets.
Figure 9:
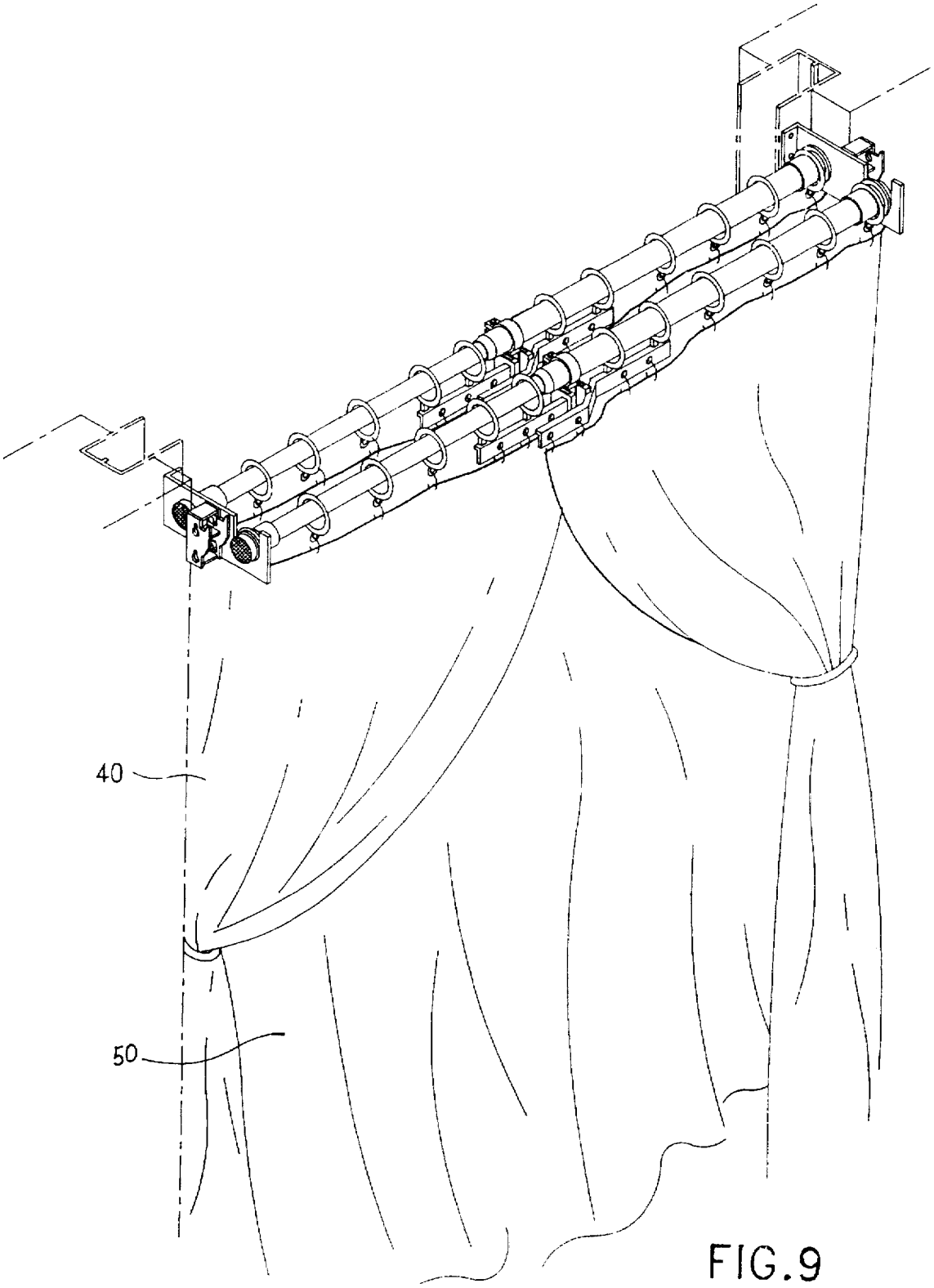
FIG. 9 is a schematic diagram of the present invention with a main curtain and a screen curtain hung on the curtain frame shown in FIG. 8.

Refer to FIG. 8 and FIG. 9, which shows a second main stretchable beam 10 been mounted to the pair of "U" shaped openings 312 of the main brackets 31 of the mounting brackets 30 (FIG. 8) for hanging a main curtain 40, let the first main stretchable beam 10 to hang a screen curtain 50 thereon (FIG. 9).

Figure 10:
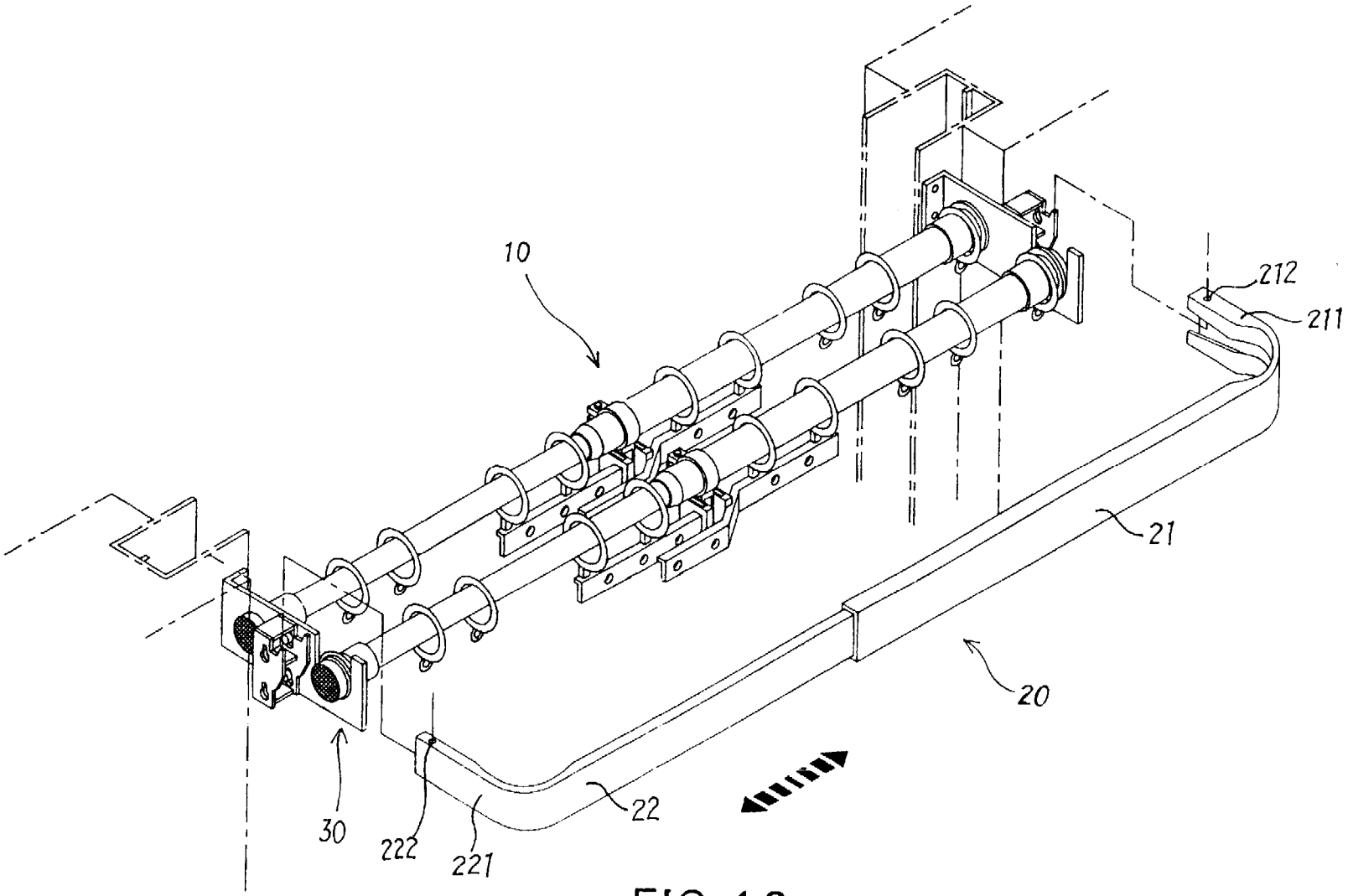
FIG. 10 is a schematic diagram showing an additional stretchable beam prepared to mount onto the frame of the present invention.
Figure 11:
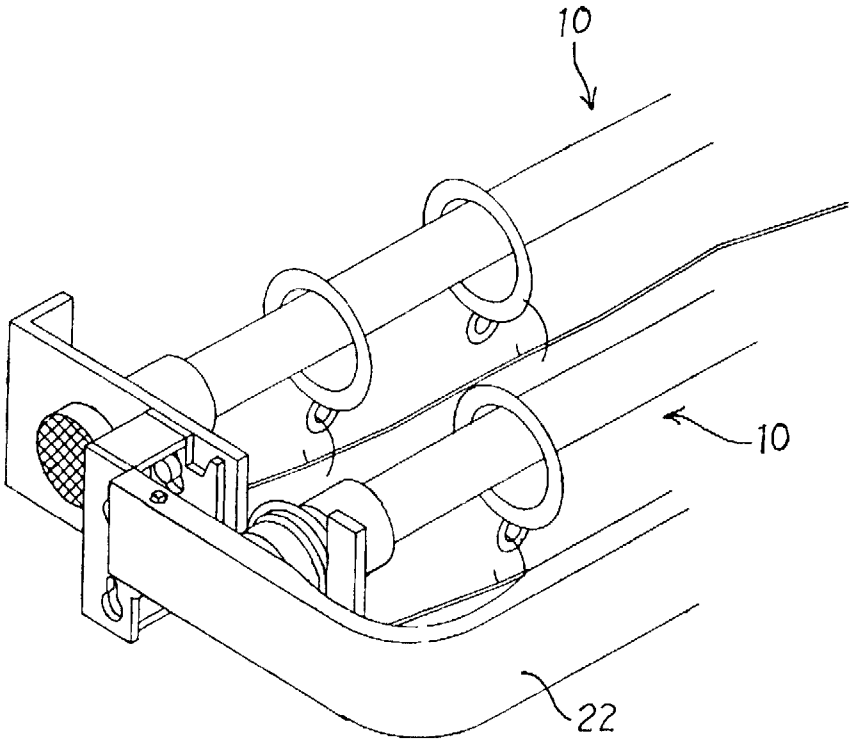
FIG. 11 is an enlarged diagram of a part of the additional beam shown in FIG. 10.
Figure 12:
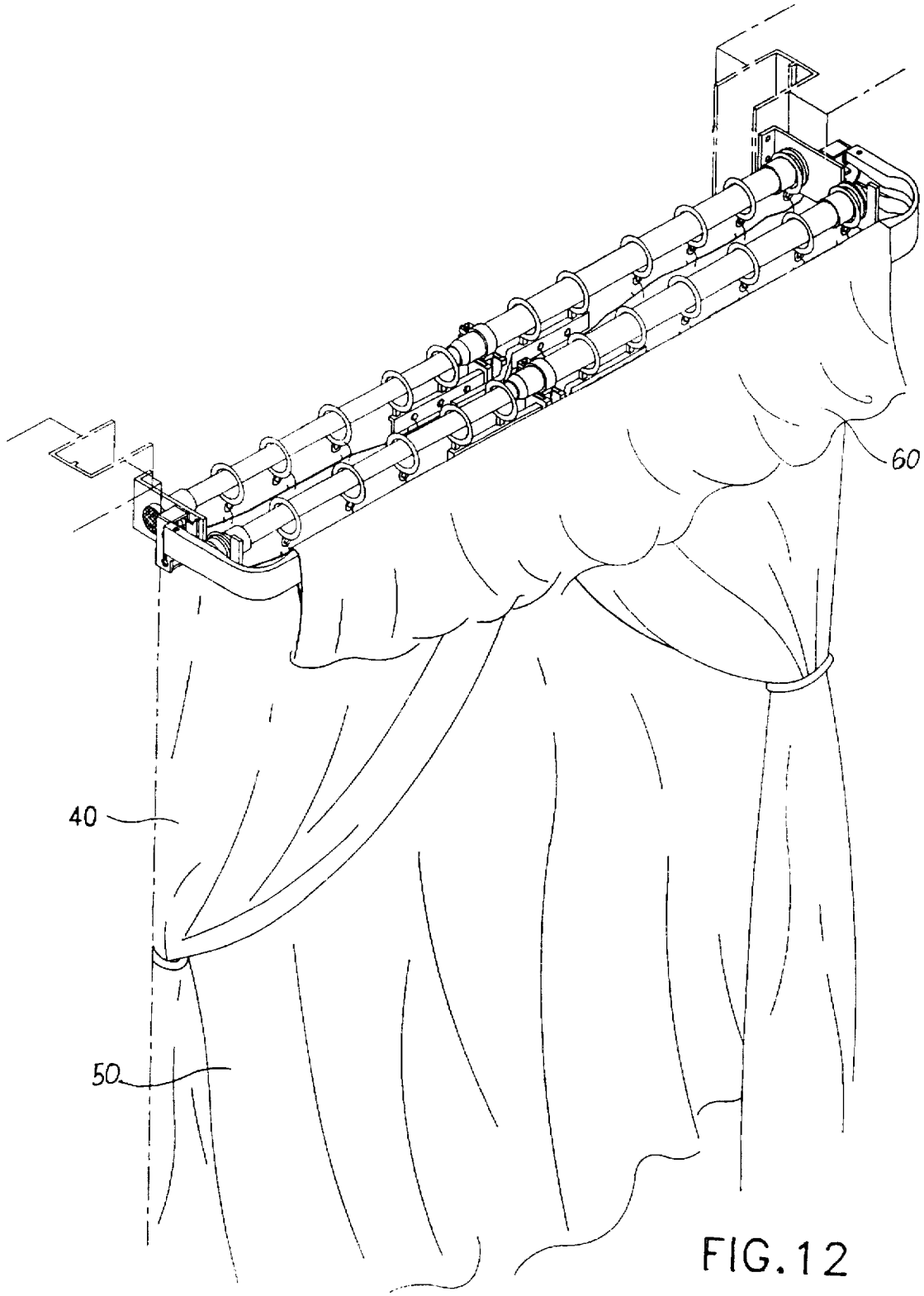
FIG. 12 is a schematic diagram showing a front decorative cloth worn on the additional stretchable beam of the present invention with a main curtain and a screen curtain thereon.

Refer to FIG. 10 through FIG. 12, an additional rectangular stretchable beam 20 is mounted to a pair of attachable brackets 32 for wearing a decorative cloth 60 thereon (FIG. 12). The additional rectangular stretchable beam 20 composes a larger main rectangular tube 21 and smaller inner rectangular tube 22 sleeved together, respectively having a bended portion 211 and 221 with a respective small square mortise 212 and 222 at a top side near an end edge of the bended portion 211 and 221; the additional stretchable beam 20 will be mounted to the attachable brackets by forcing the rectangular space of respective end edge of the bended portion 211 and 221 fully sleeved over the respective tenon piece 322 of the attachable bracket 32 and to lock up by a downward push for tenoning the small square upward tenon 323 of the attachable brackets 32 into the mortises 212 and 222 respectively while a decorative cloth 60 is needed.

The above embodiment can be modified by any skillful person in the art without departing the spirit and scope of the accompanying claims.

What is claimed is:

1. A free size curtain frame for a two-pieced curtain comprises:

a pair of "L"-shaped mounting brackets respectively composed of a flat plate for fixing on a top end of a respective side member of a window frame, a vertical plate having at least two supporting openings and at least two T-head tenons disposed thereon;

at least one stretchable tubular beam comprising a beam body composed of a set of telescopic tubes in order to fit the width of various windows, two end caps fastend to two ends of said beam body far mounting said beam to said supporting openings of said mounting brackets, a plurality of hanging rings movably hanged on said beam body, a positioning pipe clamp disposed at a middle of said beam body having a magnet housing at a lower portion for inserting a magnet piece therein, a couple of guide bars composed of a flat bar and a folded bar respectively hanged on at least two said hanging rings nearest to said positioning pipe clamp of adjustment sides having an iron piece housing for receiving an iron piece therein disposed at an end of flat portion toward said magnet housing of said positioning pipe clamp;

an additional stretchable beam prepared for wearing a decorative cloth composed of a couple of rectangular tubing sleeve one over the other thereinto having a respective bended portion at one end thereof and a small square mortise disposed to a top side of said bended portion near an end edge thereon;

a pair of attachable brackets formed of a box shape respectively having at least two key hole shaped mortises disposed on each side wall for attaching to said T-head tenons of said mounting brackets thereon, a lateral tenon piece with a small square upward tenon disposed on either side wall for tenoning into a rectangular space of an end edge of said bended portion of said rectangular tubes and to lock up by a downward push for tenoning said small square tenon of said tenon piece of said attachable bracket into said small square mortise of side bended portion of said additional stretchable beam.

* * * * *